US008410955B2

(12) United States Patent
Schmidt et al.

(10) Patent No.: US 8,410,955 B2
(45) Date of Patent: Apr. 2, 2013

(54) MODULE WITH A RADIO TRANSCEIVER DEVICE AND AN ACTUATOR, SYSTEM, AND METHOD WITH THIS MODULE AND A CENTRAL UNIT

(75) Inventors: Frank Schmidt, Altkirchen (DE); Andreas Schneider, Munich (DE); Christian Bach, Ottobrunn (DE)

(73) Assignee: Enocean GmbH, Oberhaching (DE)

( * ) Notice: Subject to any disclaimer, the term of this patent is extended or adjusted under 35 U.S.C. 154(b) by 492 days.

(21) Appl. No.: 12/671,904

(22) PCT Filed: Jul. 21, 2008

(86) PCT No.: PCT/EP2008/059538

§ 371 (c)(1),
(2), (4) Date: Feb. 2, 2010

(87) PCT Pub. No.: WO2009/021807

PCT Pub. Date: Feb. 19, 2009

(65) Prior Publication Data

US 2011/0121990 A1 May 26, 2011

(30) Foreign Application Priority Data

Aug. 10, 2007 (DE) ..... 10 2007 037 895

(51) Int. Cl.
*G08C 19/04* (2006.01)

(52) U.S. Cl. ..... 340/870.39; 340/601; 361/117; 455/574; 455/68

(58) Field of Classification Search ..... 340/870.39, 340/601; 361/117; 455/574, 68
See application file for complete search history.

(56) References Cited

U.S. PATENT DOCUMENTS

2004/0077383 A1 4/2004 Lappetelainen et al.
2005/0041355 A1* 2/2005 Page ..... 361/117

FOREIGN PATENT DOCUMENTS

| | | | |
|---|---|---|---|
| DE | 40 14 622 | A1 | 11/1991 |
| DE | 195 31 759 | A1 | 3/1997 |
| DE | 103 01 678 | A1 | 8/2004 |
| DE | 10 2004 032618 | A1 | 2/2005 |
| EP | 1 135 944 | B1 | 10/2004 |
| EP | 0 760 560 | B1 | 5/2005 |

* cited by examiner

*Primary Examiner* — Jean B Jeanglaude
(74) *Attorney, Agent, or Firm* — Foley & Lardner LLP

(57) ABSTRACT

A module with a radio transceiver device, an actuator, and an activation device. Also disclosed is a system comprising such a module and a central unit, and a method with such a module and a central unit and the activation device with the radio transceiver device. The radio transceiver device is coupled with the actuator and with an electrical energy source, and the activation device is constructed to feed electrical energy from the electrical energy source to the radio transceiver device and the actuator.

28 Claims, 2 Drawing Sheets

MODULE WITH A RADIO TRANSCEIVER DEVICE AND AN ACTUATOR, SYSTEM, AND METHOD WITH THIS MODULE AND A CENTRAL UNIT

RELATED APPLICATIONS

This is a U.S. national stage of application No. PCT/EP2008/059538, filed on Jul. 21, 2008.

This application claims the priority of German application no. 10 2007 037 895.7 filed Aug. 10, 2007, the entire content of which is hereby incorporated by reference.

FIELD OF THE INVENTION

The invention relates to a module with a radio transceiver device, an actuator, and an activation device. The invention further relates to a system and a method comprising such a module and a central unit.

BACKGROUND OF THE INVENTION

Modules with the features described in the introduction are constructed to communicate, for example, with the central unit wirelessly, for example, by means of radio signals. By means of this wireless communications, information is exchanged between the module and the central unit. Here, the module transmits, for example, a unique identification code to the central unit in order to identify itself relative to this code. The central unit, in turn, transmits data to the module, wherein this data provides target values for the actuator to the module. The module converts the data into an electrical signal, which is fed as a target value, setting value, or drive signal to the actuator. The actuator converts the electrical signal into a physical effect. This can be a rotation of a servomotor or an action on an electromechanical switch element. Together with the actuator, such a module fulfills the task of either turning on or off or also controlling or regulating, by means of the actuator, a control, regulating, or lighting device or other technical devices. The actuator used in the module or interacting with the module depends on the technical device on which the actuator acts or with which the actuator is coupled. If the actuator is merely an electromechanical switch, then this is suitable, for example, for turning on and off lighting devices or other electrical loads. If the actuator is an electric motor, then this is suitable for regulating devices, for example, for actuating heating valves or other building-related devices. By means of the central unit, communications with a plurality of such modules is possible. In this way, a plurality of control or regulating devices, such as radiator valves or electrical loads, can be controlled, regulated, or also merely turned on or off centrally.

Electrical energy supply to the module is needed in order to receive each message for the module from the central unit and to perform an action by means of the actuator. The message is transmitted by means of a radio signal from the central unit to the module. The module must be supplied with electrical energy in order to be able to receive the message because only then is the radio transceiver unit also ready to receive. This means that a consumption of electrical energy is connected with the reception of the message, which also lasts through the time periods during which the central unit transmits no message to the module. This means that electrical energy is consumed at the module also during the transmission pauses in which no signal is transmitted to the module. Higher energy consumption is the result.

SUMMARY OF THE INVENTION

One object of the invention is to reduce the energy consumption on the part of the module.

In the following, the method with the module, the module itself, and a system with the module and a central unit are described.

A module is provided with a radio transceiver device, an actuator, and an activation device. The activation device is coupled with the radio transceiver device and the actuator and an energy source and is constructed to feed electrical energy from the electrical energy source to the radio transceiver device and the actuator.

The radio transceiver device comprises a transmitter unit and a receiver unit, as well as an evaluation unit that evaluates and/or controls signals to be transmitted or those that were received with the radio transceiver device. Received signals comprise, for example, values that are fed to the actuator as a control value or as a target value by means of an electrical signal. As the actuator, nearly any device can be used that, by means of an electrical signal, either initiates a mechanical motion or triggers an electrical switching or control process, and is thus not limited just to an electromechanical switch or an electrometer. The actuator has, in general, the task of converting an electrical signal into a physical parameter. Thus, an actuator can be, for example, a part of an air-conditioning system or a heating system. In a simple case, the electrical signal to the actuator is a turn-on or a turn-off command, or a control signal that acts on a valve by means of an electric motor, whereby a temperature change in a heating system is realized that leads to a temperature change by means of the actuator, or to the action triggered by the actuator. Thus, electromechanical, inductive, capacitive, pyroelectric, photoelectric, piezoelectric, or thermoelectric actuators are provided as the actuators. Actions caused by the actuator are, for example, a lighting control by means of a dimmer switch, a temperature control by means of a heating or air-conditioning system, transmission of an alarm signal, and transmission of information on a communications medium, such as telephone, mobile radio, or Internet.

Different energy sources are possible for powering the module with electrical energy, for example, a public power grid connection that uses the electrical system in the house as an energy source, or an accumulator or another electrochemical storage device. Other energy sources can also be used, such as thermoelectric converters, piezoelectric converters, or other electrical converters which convert the energy present in the surroundings, such as light, temperature, or motion into electrical energy. Thus, for example, the heat of a heating system or its radiators, which are installed in a building, can be used as a heat source for a thermoelectric converter.

Through the coupling of the activation device with the energy source on the one hand, and of the actuator and the radio transceiver device on the other hand, the activation device forms a connection between the energy source and the radio transceiver device and the actuator. The activation device thus determines the energy supply to the module. The activation device itself is always provided with electrical energy from the energy source. This applies at least as long as the energy source itself has sufficient energy for powering the activation device.

In this way, it is achieved that the energy-intensive components of the module, such as the radio transceiver device and the actuator, are provided with electrical energy only when the activation device supplies electrical energy to the radio transceiver device and to the actuator.

In one refinement of the measures described above, the activation device controls the supply of electrical energy to the radio transceiver device and to the actuator as a function of an available amount of electrical energy. For this purpose, the module preferably has means that determine the amount of available electrical energy in the energy source. Preferably, the means also comprise decision algorithms, which, by means of an electronic comparison device decide, as a function of the energy level in the energy source, whether there is sufficient energy for powering the radio transceiver device and the actuator, and feeds electrical energy to the radio transceiver device and to the actuator only when there is sufficient energy.

This is refined in that the activation device can be controlled through predeterminable or random time intervals, and thus the supply of electrical energy to the radio transceiver device and to the actuator occurs according to predeterminable, essentially regular time intervals or else also random time intervals. One refinement provides the supply of electrical energy according to predeterminable or random time intervals in combination with the supply of electrical energy to the radio transceiver device as a function of the amount of electrical energy available in the energy source. Another energy potential is formed, because, in this way, the time intervals can also be changed as a function of the available amount of electrical energy.

This is then especially advantageous when the electrical energy is formed in the energy source by means of a conversion of environmental energy into electrical energy. This is because the electrical energy is not always available in the same amount. Also, the environmental energy is not always available at the point in time when electrical energy is needed. Thus, if the energy source is supplied from solar energy, for example, by means of a photoelectric converter, then electrical energy is available only during the day or only when there is sufficient light irradiation. For this reason, it is preferred, in connection with an electrical energy source supplied with environmental energy, to provide an electrical energy storage device in which the converted electrical energy is stored for the time of need.

The converter is based, just like the actuator, on an electrophysical principle that converts environmental parameters into electrical energy. In interaction with the module, the converter is directed toward the most efficient energy yield possible, so that in connection with a module, different physical parameters than those generated with the actuator can be used for obtaining energy. The converter is to be selected according to the installation site and the most frequently occurring form of convertible energy at this site. The converter, just like the actuator, is formed according to an electromechanical, inductive, capacitive, pyroelectric, photoelectric, piezoelectric, or thermoelectric principle or a combination of these.

For time-dependent control of the energy supply, the activation device preferably includes a time-generating element. The time-generating element is an element of the activation device, which is always connected to the energy source, and thus is always supplied with energy, as long as the energy source also has sufficient energy for powering this time-generating element.

With the supply of electrical energy to the radio transceiver device, the radio transceiver device first transmits a first radio signal and, in this way, transmits its receive or communications readiness to a central unit at a remote site. The first radio signal thus forms a communications readiness signal. The remote central unit receives and evaluates this signal and recognizes, by means of comparison algorithms, that a radio transceiver device of a module has transmitted its receive or communications readiness by means of this signal. By means of the comparison algorithm, it can also be determined from which module the communications readiness signal was sent. In particular, an identification of each individual module is advantageous when a plurality of modules is in radio communication with the central unit. The module or the radio transceiver device transmits an identification signal with the communications readiness signal. This identification signal can be transmitted in the form of a digital ID number. The remote unit receives and identifies a radio signal for signaling the communications readiness of a certain radio transceiver device, and thus a certain module of a plurality of modules within the effective range of the central unit. The central unit comprises a data storage device, which stores the data to be transmitted to the individual modules. The data storage device stores the data for each individual module until the data has been successfully transmitted to each individual module.

After reception of the communications readiness signal by the central unit, the information packet provided for the module at the central unit is selected from the data storage device and sent from the central unit by means of a radio signal. The radio signal can be received by the module. After successful reception of the information packet, the module can end the reception readiness of the radio transceiver device and can, in this way, save electrical energy. The information packet can be augmented with a completion signal. The reception readiness is ended when the completion signal is received. The received data is evaluated after its reception.

As an alternative to the communications between the central unit and the module just described, joint bidirectional communications can be set up by the two parties, by means of which not only can an information packet be on the one hand transmitted from the central unit to the module, but also values or information can be transmitted from the module to the central unit. This is, for example, a confirmation signal after all of the data of the information packet has been received, or measurement data of a sensor that is coupled with the module or that is integrated into the module. In connection with bidirectional communications, the information can also be augmented with a completion signal. When the completion signal is received, the bidirectional communications are ended.

During the bidirectional communications, the radio transceiver device of the module receives all of the information stored and prepared for it at the central unit. With this information, the module executes actions by means of the actuator, activating a control or regulating device or a switch. Also, the actuator is supplied with electrical energy by the activation device.

The bidirectional communications are maintained either until all of the data of the central unit is transmitted to the module, a completion signal has been received, or the module breaks the communications due to decreasing electrical energy in the energy source. For this case, the central unit retains the non-transmitted information in its storage device and transmits the remaining information with the next radio connection established with the module.

In order to be able to perform the processes described above, the central unit has available a radio transceiver device so that radio signals can be received and also transmitted by the central unit.

As already mentioned, the module can also be expanded with a sensor. This is similarly supplied with electrical energy by means of the activation device. The sensor detects a physical value and converts this into an electrical signal that is a reference signal for the physical value. The value detected by the sensor can be transmitted to the central unit by means of the radio transceiver device. This also offers the advantage that the central unit is immediately provided with actual values at the sensor and these can be supplied for processing. Thus, the target values transmitted to the actuator can be immediately recalculated and transmitted to the actuator via the radio transceiver device. The bidirectional communications between the module and the central unit allows such a method in connection with the sensor on the module.

DETAILED DESCRIPTION OF THE DRAWINGS

Figure 1:
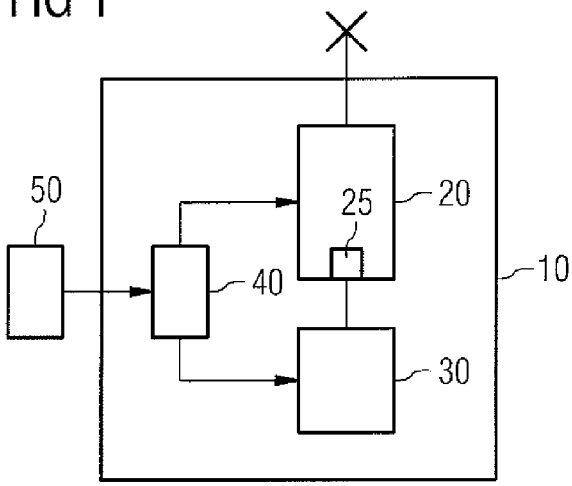
FIG. 1, a schematic diagram of the module.

In FIG. 1, a module 10 with individual components is shown in a schematic diagram, wherein the module 10 in this embodiment shown in FIG. 1 has a radio transceiver device 20, which has an antenna designed for transmitting and receiving radio signals. The radio transceiver device 20 is coupled with an actuator 30 and has means 25 for communicating with the actuator 30 or for forwarding signals to the actuator 30, so that a mechanical movement or another physical effect can be triggered by an electrical signal by means of the actuator 30.

The two components, both the radio transceiver device 20 and also the actuator 30 are coupled with an activation device 40. The activation device 40 supplies electrical energy to the radio transceiver device and to the actuator 30 for their operation. For this purpose, the activation device 40 is coupled with an energy source 50. The activation device 40 receives the electrical energy, which the energy source 50 feeds to the radio transceiver device 20 and the actuator 30, and is, here, connected to the energy source 50 and supplied with electrical energy from this source. The energy-intensive processes of the module 10, for example, the transmission or the reception of radio signals, as well as the generation of physical values or effects by means of the actuator or the execution of movements by means of the actuator, such as to drive an electric motor, are thus limited to the time periods in which electrical energy is supplied to the radio transceiver device and/or to the actuator. The energy supply to the radio transceiver 20 and to the actuator 30 is consequently dependent on the activation device 40.

The activation device 40 is constructed for supplying energy to the radio transceiver device 20 and the actuator 30. For this purpose, different variants are provided. In a first variant, the radio transceiver device 20 and the actuator 30 are supplied with energy with the activation device 40 by means of a time-defined sequence, in predeterminable or random time intervals. Thus, the energy-intensive processes are operated only throughout the time period during which the activation device supplies these processes with energy. In another variant, the energy supply of the radio transceiver device 20 and the actuator 30 is controlled as a function of the energy level in the energy source 50. Thus, for example, for a low energy level in the energy source 50, it is possible to select longer time intervals between energy supply or to shorten the duration of energy supply to the radio transceiver device 20 and to the actuator 30. If the energy level in the energy source 50 rises, then the time intervals can be adjusted. As the energy source 50, for example, a public power grid supply from typical household installations is to be used. In this case, sufficient energy reserves in the energy source 50 can be assumed, because this delivers electrical energy in a sufficient amount. For household installations with a plurality of modules supplied with information by a central controller, the energy-saving potential is especially large just on the basis of the plurality of modules.

Another example of an energy source 50 is the energy source from environmental energy. For this purpose, an electrophysical converter is provided that converts the energy present in the surroundings of the module into electrical energy. Such an energy source is advantageously coupled with an electrical energy storage device, for example, with a capacitor or an accumulator.

As an alternative, an energy storage device in the form of an electrochemical battery or an electrochemical accumulator can also be used as the energy source 50. However, the energy reserves in the energy source are limited compared with the public power grid supply. The energy saving advantage gains significantly in importance with such an energy source, because the need for radio transmission events can be reduced to a minimum with the provided module 10.

Figure 2:
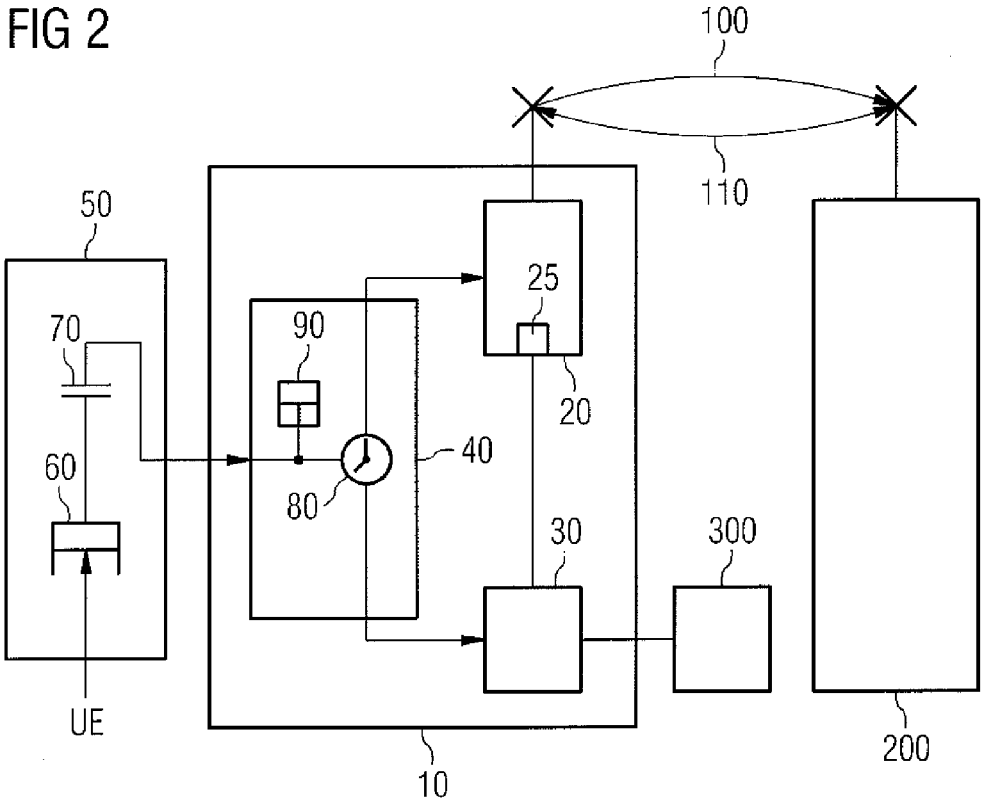
FIG. 2, a schematic diagram of the system with the module.

FIG. 2 shows a module, which is coupled with an energy source 50 that comprises a converter 60. The converter 60 is designed to convert environmental energy into electrical energy. The environmental energy can now be formed by thermal energy in the form of a temperature difference along a temperature gradient or a change in temperature across time. However, energy forms that can be converted into electrical energy are also represented by light or motion or vibration or other energy forms convertible to electrical energy.

Furthermore, the energy source 50 of the embodiment of FIG. 2 has an energy storage device 70 which, for example, is formed as a capacitive energy storage device in the form of a capacitor. The electrical energy obtained by the converter 60 is fed to the energy storage device 70 and, here, made available to the activation device 40. The activation device 40 has a time-generating element 80 and means 90 for detecting the energy level in the energy source 50. Thus, the radio transceiver device 20 and the actuator 30 can be supplied with electrical energy by the time-generating element at regular or random time intervals. The time-defined energy supply or the energy supply at random time intervals enables the energy resources of the energy source to be significantly conserved. In addition, with the means 90 it is possible to adapt the time interval for supplying energy to the radio transceiver device 20 and to the actuator 30 to the energy level of the energy source 50.

The actuator 30 is coupled with a control or regulating device 300, which is part of a building-specific installation. This is, for example, a heating device, an air-conditioning system, a lighting device, a light switch, an alarm system, or the like.

If the radio transceiver device 20 is supplied with electrical energy by the activation device 40, then the radio transceiver device 20 begins its radio operation with a first radio signal that is a communications readiness signal 100. This communications readiness signal 100 is transmitted and received by a remote central unit 200. The remote central unit 200 identifies the module that has transmitted the signal, determines whether information is present for the module, and transmits this information by means of a radio signal to the radio transceiver device 20. In the embodiment, bidirectional communications 110 are provided, but the communications do not have to be bidirectional. Bidirectional communications between the central unit 200 and the module 10 offers the advantage, for example, that the radio transceiver device 20 of the module 10 can confirm the completed reception by means of a confirmation signal to the central unit 200.

Figure 3:
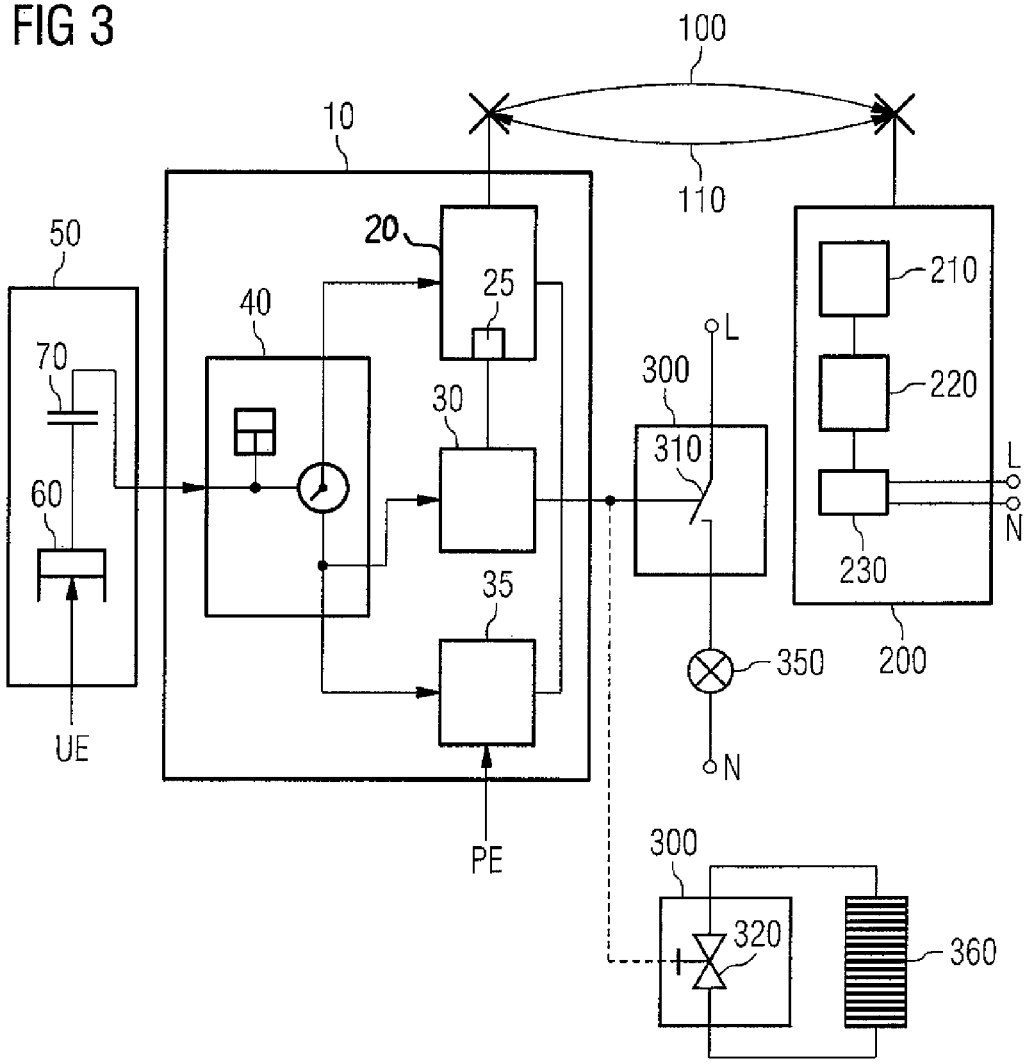
FIG. 3, the system with the module in connection with a building-specific system.

FIG. 3 shows an embodiment in which the module 10 is also equipped with a sensor 35 and shows examples for the central control or regulating device 300.

The module 10 with the sensor 35 can detect physical effects PE, such as temperature, light, air pressure, moisture, or other physical effects, which can be converted into an electrical signal. These are converted into an electrical signal, and this is transmitted to the radio transceiver device 20 for transmission to the remote unit 200 by means of bidirectional communications 110.

The sensor 35 and actuator 30 are essentially similar in their basic physical active principles, often only inverted relative to each other. Thus, the application of an electrical voltage to a coil of an electromagnetic converter induces a magnetic field, which exerts a mechanical force on a ferromagnetic body. In reverse, a mechanical force or a movement of the ferromagnetic body in the magnetic field of the electromagnetic converter induces an electrical voltage on the coil. What sensor and actuator are used is dependent on the environmental conditions to be detected or on the technical unit coupled with the module.

For its part, the remote unit 200 also comprises a radio transceiver unit 210, a processor and storage device 220, and a separate energy supply 230, which is supplied with energy by means of the public power grid supply. This is formed in the embodiment by an L-conductor and an N-conductor, which form the phase conductor and the neutral conductor. The remote unit 200 is coupled, for example, with additional sensors or devices to detect physical values from the surroundings and feed them to a calculation for new target values and control values. These additional sensors or devices are not shown in the figure. The processor and storage device 220 processes the signals transmitted by the radio transceiver device 20 of the module 10 and received by the remote central unit 200. Through real-time processing of the signals, after the calculation of new target values, the new target values can be transmitted immediately to the module by means of bidirectional communications 110. The module receives the new target values by the radio transceiver device 20 and relays a corresponding signal via the means 25 to the actuator 30, whereby this actuator controls the control and regulating device 300.

The control and regulating device 300 of the embodiment shown in FIG. 3 can be, first, an electrical switch 310 that couples the electrical load 350 to a public power grid supply, wherein the public power grid supply is formed by the N-conductor and L-conductor. Also, the control and regulating device 300 can be a control valve 320, which is activated by means of an electric motor and controls, for example, a heating element 360.

In an especially energy-saving variant of the module 10, the communications 110 are not bidirectional, but instead, after transmitting a communications readiness signal 100, the radio transceiver device is constructed merely for radio reception and, thus, additional energy is saved. Here, the transceiver device merely waits for a radio signal transmitted by the central unit 200 and, after the radio signal is received from the central unit 200, action on the actuator by the activation device 40 ends the energy supply to the radio transceiver device and the actuator.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A module comprising:

a radio transceiver device;

an actuator; and an activation device, wherein the activation device is coupled with the radio transceiver device, with the actuator, and with an electrical energy source, the electrical energy source comprising a thermoelectric converter constructed to convert environmental energy into electrical energy, and wherein the activation device is constructed to feed electrical energy from the electrical energy source to the radio transceiver device and/or to the actuator.

2. The module according to claim 1, wherein the activation device is constructed to control the supply of electrical energy to the radio transceiver device and the actuator as a function of an available amount of electrical energy.

3. The module according to claim 1, wherein the activation device is constructed to control the supply of electrical energy to the radio transceiver device and the actuator according to predeterminable or random time intervals.

4. The module according claim 1, wherein that the electrical energy source is formed by a public power grid supply.

5. The module according to claim 1, wherein the activation device has means, which are constructed to determine the amount of available electrical energy in the energy source and feed electrical energy to the radio transceiver device and the actuator as a function of the amount of available electrical energy.

6. The module according to claim 1, wherein the electrical energy source comprises an electrical energy storage device.

7. The module according to claim 1, wherein the activation device comprises a time-generating element, which controls the time intervals of the supply of electrical energy.

8. The module according to claim 1, wherein with the reception of electrical energy, the radio transceiver device transmits a communications readiness signal designed to signal the reception readiness of the radio transceiver device to the remote unit, and wherein the radio transceiver device is ready for reception after transmission of the communications readiness.

9. The module according to claim 8, wherein the radio transceiver device ends the reception readiness after a predeterminable quantity of data is received, after a predeterminable time, or after the reception of a completion signal.

10. The module according to claim 1, wherein with the reception of electrical energy, the radio transceiver device transmits a communications readiness signal designed to signal the communications readiness of the radio transceiver device to a remote unit and wherein the radio transceiver device communicates with a bidirectional method with the remote unit after transmission of the communications readiness.

11. The module according to claim 10, wherein the radio transceiver device ends the bidirectional communications after a predeterminable quantity of data, after a predeterminable time, or after reception of a completion signal.

12. The module according to claim 1, wherein the actuator is an electromechanical drive coupled with a control and/or regulating device.

13. The module according to claim 12, wherein the control and/or regulating device is a control and/or regulating component of a heating system.

14. A system with at least one module comprising:

a radio transceiver device;

an actuator; and an activation device;

wherein the activation device is coupled with the radio transceiver device, with the actuator, and with an electrical energy source, the electrical energy source comprising a thermoelectric converter constructed to convert environmental energy into electrical energy, wherein the activation device is constructed to feed electrical energy from the electrical energy source to the radio transceiver device and/or to the actuator, and wherein a central unit is provided, constructed to receive, transmit, and process radio signals and to communicate wirelessly with the radio transceiver device of the module.

15. The system according to claim 14, wherein, after reception of the communications readiness signal, the central unit transmits data, assigned to the radio transceiver device, to this transceiver device a bidirectional data transmission formed by means of a radio signal, and the bidirectional communications are maintained with the radio transceiver device until the radio transceiver device ends the bidirectional communications .

16. The system according to claim 14, wherein, after reception of the communications readiness signal, the central unit transmits data, assigned to the radio transceiver device, to this transceiver device by means of a unidirectional data transmission formed by a radio signal.

17. A method for operating a module and a central unit, wherein the module comprises an activation device, a radio transceiver device, and an actuator, wherein the activation device supplies electrical energy from an electrical energy source to the radio transceiver device and to the actuator, the electrical energy source comprising a thermoelectric converter constructed to convert environmental energy into electrical energy, and wherein with the supplied electrical energy, the radio transceiver device transmits a communications readiness signal that signals to a remote central unit that the radio transceiver device is ready for reception.

18. The method according to claim 17, wherein the actuator is operated by the supplied electrical energy, wherein the actuator is coupled with a control and/or regulating device.

19. The method according to claim 17, wherein the activation device controls the supply of electrical energy to the radio transceiver device and the actuator as a function of an available amount of electrical energy.

20. The method according to claim 17, wherein the activation device controls the supply of electrical energy to the radio transceiver device and the actuator according to predeterminable or random time intervals.

21. The method according to claim 17, wherein the electrical energy is drawn from a public power grid supply.

22. The method according to claim 17, wherein the electrical energy source converts environmental energy into electrical energy, and the converted energy can be fed as electrical energy to the radio transceiver device and the actuator by the activation device.

23. The method according to claim 22, wherein environmental energy converted into electrical energy is stored by an electrical energy storage device.

24. The method according to claim 17, wherein the time intervals of the supply of electrical energy can be regulated by a time-generating element.

25. The method according to claim 17, wherein the amount of available electrical energy in the energy source is determined, and electrical energy is fed to the radio transceiver device and the actuator as a function of the amount of available electrical energy.

26. The method according to claim 25, wherein the reception readiness is ended after the transmission of a predeterminable quantity of data, after a predeterminable time, or after reception of a completion signal.

27. The method according to claim 17, wherein with the supplied electrical energy, the radio transceiver device transmits a communications readiness signal, which signals to a remote central device the communications readiness of the radio transceiver device, after which bidirectional communications between the radio transceiver device and the remote central unit are established and conducted.

28. The method according to claim 27, wherein the bidirectional communications between the radio transceiver device and the central unit end after transmission of a predeterminable quantity of data or after a predeterminable time.

* * * * *